United States Patent [19]

West

[11] 4,162,771

[45] Jul. 31, 1979

[54] ROD TENSIONER

[75] Inventor: Robert L. West, Portland, Oreg.

[73] Assignee: Ameron, Inc., Monterey Park, Calif.

[21] Appl. No.: 824,404

[22] Filed: Aug. 15, 1977

[51] Int. Cl.[2] ..... B21F 17/00; B65H 77/00; B65H 81/08

[52] U.S. Cl. ..... 242/7.22; 242/155 BW

[58] Field of Search ..... 242/7.21, 7.22, 7.23, 242/155 BW

[56] References Cited

U.S. PATENT DOCUMENTS

| | | | |
|---|---|---|---|
| 2,749,054 | 6/1956 | Crom, Jr. | 242/7.22 |
| 3,221,401 | 12/1965 | Scott et al. | 242/7.23 X |
| 3,338,527 | 8/1967 | Chidzey | 242/7.22 |
| 3,770,219 | 11/1973 | Hickman | 242/7.22 |
| 4,059,238 | 11/1977 | Vogt | 242/7.21 |

*Primary Examiner*—Billy S. Taylor

*Attorney, Agent, or Firm*—Christie, Parker & Hale

[57] ABSTRACT

Apparatus for applying tension to a wire rod while wrapping the rod on a pipe for prestressing the pipe. The tension device includes a frame movable lengthwise of the pipe, the frame having a shaft parallel to the pipe on which is rotatably mounted a bull wheel around which a single turn of the wire rod is wrapped. A hydraulic pump is supported on a torque frame which in turn is rotatably supported on the shaft. The pump is driven in response to rotation of the bull wheel. A load-sensing element is mounted on the frame and engages the torque frame at a radial distance from the axis of the shaft that is substantially equal to the radius of the bull wheel. The hydraulic load on the pump controls the torque load on the bull wheel and hence the tension in the rod as it is withdrawn tangentially from the bull wheel. The reaction torque on the torque frame is measured by the load sensing element, the sensing element thus giving a direct measure of rod tension.

7 Claims, 4 Drawing Figures

10
24
26
28
30
32
34
36
38
40
42
44
46
48
50

ROD TENSIONER

FIELD OF THE INVENTION

This invention relates to apparatus for tensioning a wire rod as it is wound on the outside of a pipe.

BACKGROUND

In the manufacturing of prestressed concrete pipe, reinforcing wire is wrapped around the pipe in a helix under tension. The wire is anchored to the pipe so as to maintain the wire in tension and the pipe in a state of compression. Prestressed concrete pipe is able to withstand much higher internal pressures as a result of the preloading effect of maintaining the wire under tension.

Various devices have heretofore been proposed for maintaining the wire under tension as it is wrapped on the outside of the pipe. One such arrangement is shown for example in U.S. Pat. No. 3,115,316. Such known systems have required multiple pump units to accommodate a wide range of tension requirements depending upon wire sizes and pipe diameters. The bull wheel around which the wire is wrapped and which controls the tension had to be mounted in a horizontal position, thus requiring expensive vertical and horizontal thrust mechanisms. Also the pumps were operated in an oil bath atmosphere requiring special oil sealing problems.

SUMMARY OF THE INVENTION

The present invention is directed to an improved design for a tensioning device for maintaining proper tension on wire as it is wrapped on concrete pipe or the like. The tensioning device is mounted on a carriage which moves horizontally in a direction parallel to the axis of the pipe being wrapped. The tensioning device feeds the wire onto the outer surface of the pipe as the pipe rotates. At the same time the tensioning device moves parallel to the pipe so as to produce a helical wrap of the pipe.

In brief, the tensioner of the present invention comprises a frame mounted on the moving carriage. A horizontal shaft is journaled on the frame and supports a rotating bull wheel around which the wire rod is wrapped in passing from a wire supply drum onto the surface of the pipe. A torque frame is rotatably supported on the same shaft. A variable volume hydraulic pump mounted on the torque frame is driven from the bull wheel. The pump produces a reaction torque which tends to rotate the torque frame about the same shaft as the bull wheel, and in the same direction. The torque frame engages a load sensing element mounted on the frame of the tensioner, the load sensing means engaging the torque frame at the same radial distance from the supporting shaft as the radius of the bull wheel. The load sensing element limits rotation of the pump supporting torque frame and provides means for measuring the reaction torque. By controlling the delivery volume and load on the pump, the reaction torque can be maintained at a predetermined level, thereby maintaining the tension on the wire between the bull wheel and the pipe at a predetermined level.

DESCRIPTION OF THE DRAWINGS

For a more complete understanding of the invention, reference should be made in the accompanying drawing wherein.

DETAILED DESCRIPTION

Figure 1:
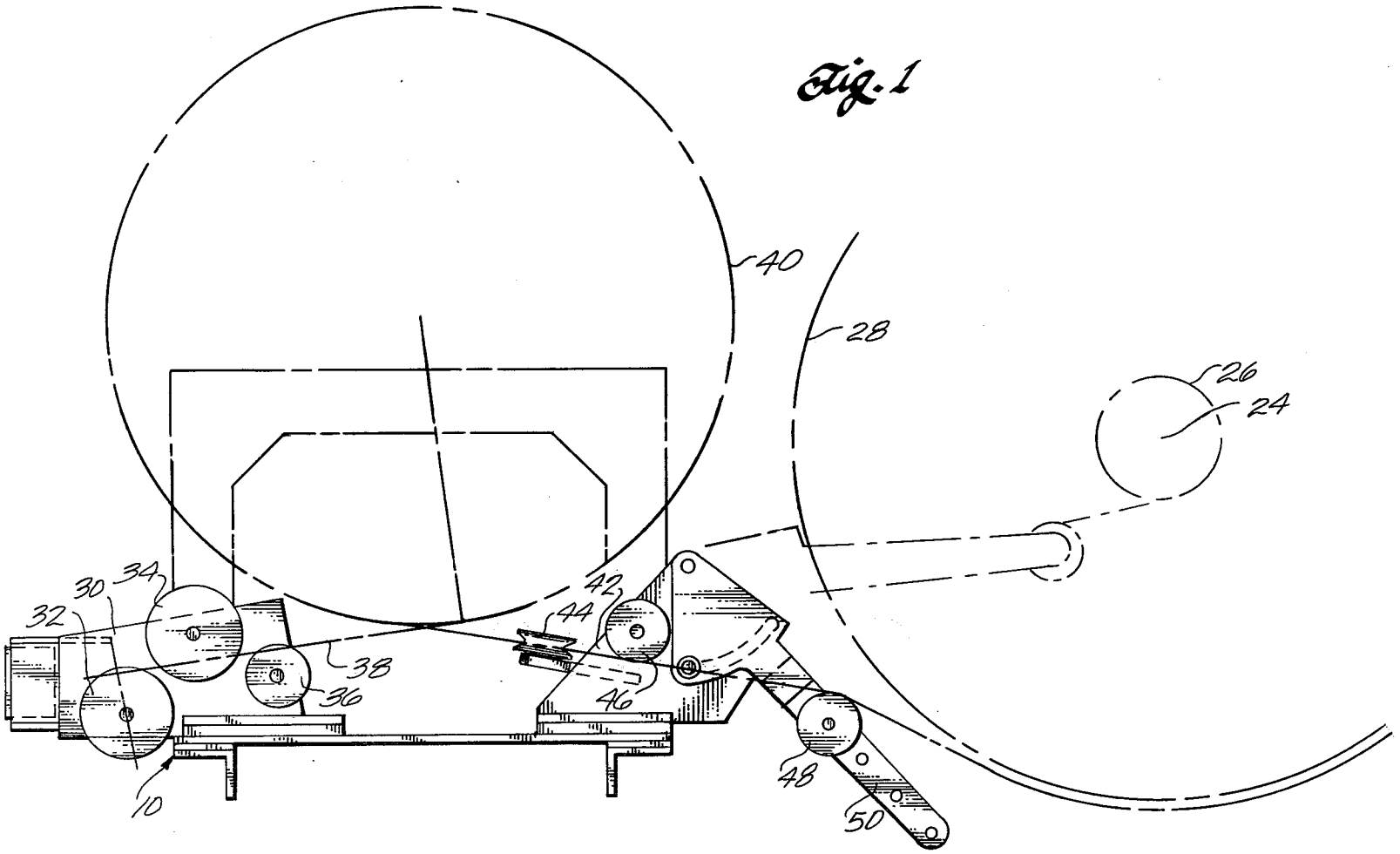
FIG. 1 is a side elevational view of the pipe wrapping machine incorporating the tensioner of the present invention.

In referring to the drawings in detail, the numeral 10 indicates generally a carriage which is adapted to move along a pair of horizontal tracks 12 and 14 on guide wheels 16 positioned above the track for supporting the weight of the carriage. The carriage 10 is held against tipping by lower guide wheels 18, and is maintained in lateral alignment with the tracks by horizontal guide wheels 20. The tensioning unit, indicated generally at 22, is mounted on and movable with the carriage 10 in a direction parallel to the axis of revolution 24 of a selection of pipe to be wrapped. Suitable means (not shown) is provided for rotating the pipe about the longitudinal axis 24, and is arranged to accommodate pipes of various outer diameters, such as indicated at 26 and 28 respectively. Wire is wound on the rotating pipe from a reel or other supply source (not shown) by directing the wire through a first guide assembly 30 mounted on the carriage 10. The assembly 30 includes a plurality of grooved pulleys 32, 34, and 36 which guide a wire indicated at 38 tangentially onto the grooved outer circumference of a bull wheel 40.

The wire extends around the bull wheel 40, which is supported on and journaled for rotation by the carriage 10 in a manner hereinafter described in detail, through an angle of substantially 340°. The wire 38, as it leaves the bull wheel, is guided onto the outer perimeter of the pipe section by a second guide assembly 42 mounted on the carriage 10. The guide assembly 42 includes a grooved pulley 44, and grooved pulley 46, which provides lateral and vertical guidance to the wire. A third grooved guide pulley 48 is mounted on an arm 50 which can be adjusted to accommodate pipes of differing diameter in guiding the wire tangentially onto the outer surface of the pipe. The carriage 10 is moved along the tracks 12 and 14 as the wire wraps itself on the pipe, so that the wire is wound in a helical path on the outside of the pipe section. The wire is secured to the pipe and the pipe is driven at substantially constant angular velocity so as to pull the wire from the supply reel around the bull wheel 40 and onto the pipe. The tensioning apparatus, hereinafter described in connection with FIGS. 2–4 acts to resist the rotation of the bull wheel by the wire as it is wound onto the pipe. Thus a tension is produced in the wire between the periphery of the pipe and the bull wheel as it passes through the guide assembly 42. When the wrapping operation is complete, the wire is anchored to the pipe so as to maintain the tension, and the wire severed so that the wrapped pipe can be removed.

Figure 2:
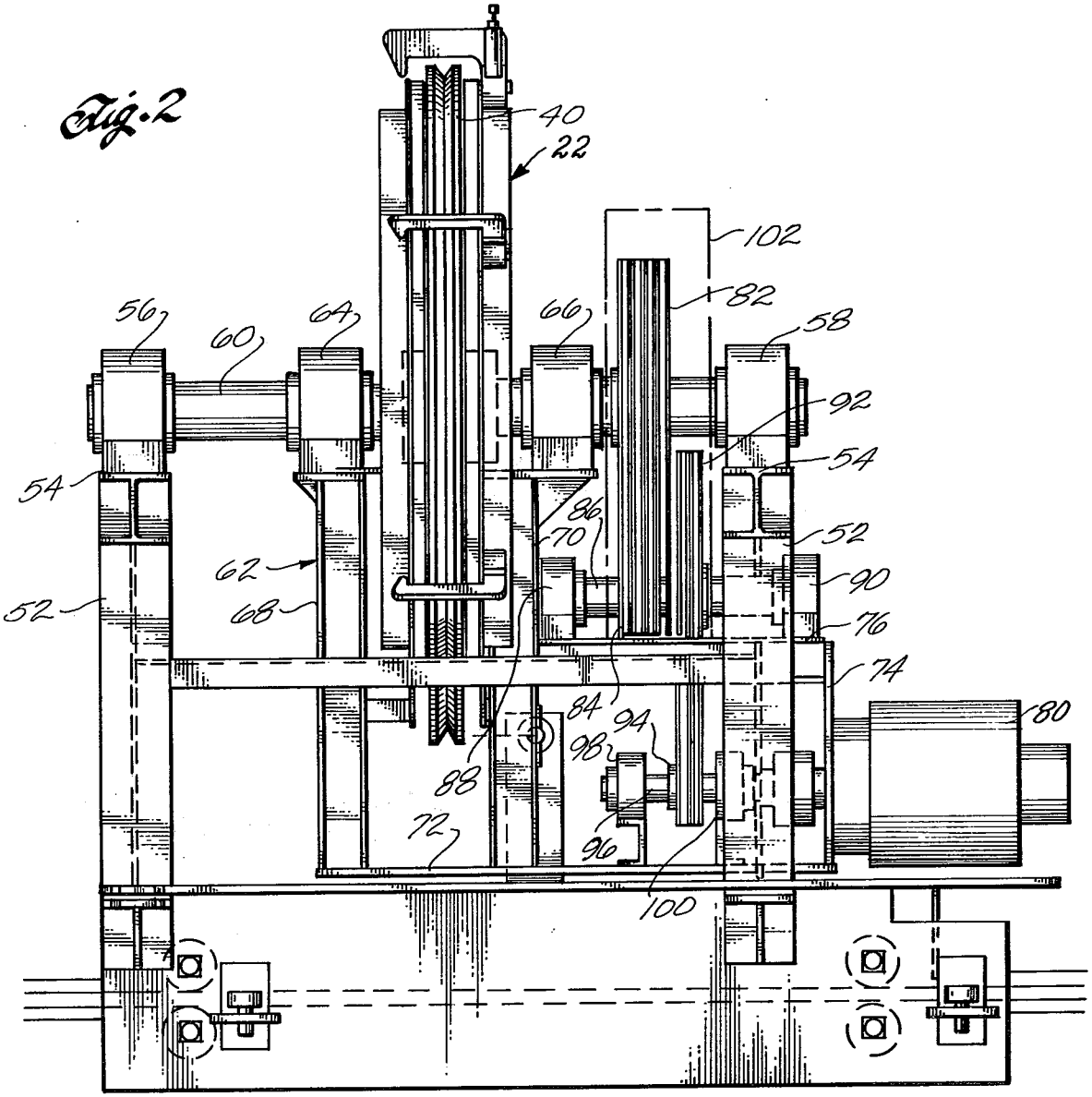
FIG. 2 is a side elevational view of the tensioning unit.
Figure 3:
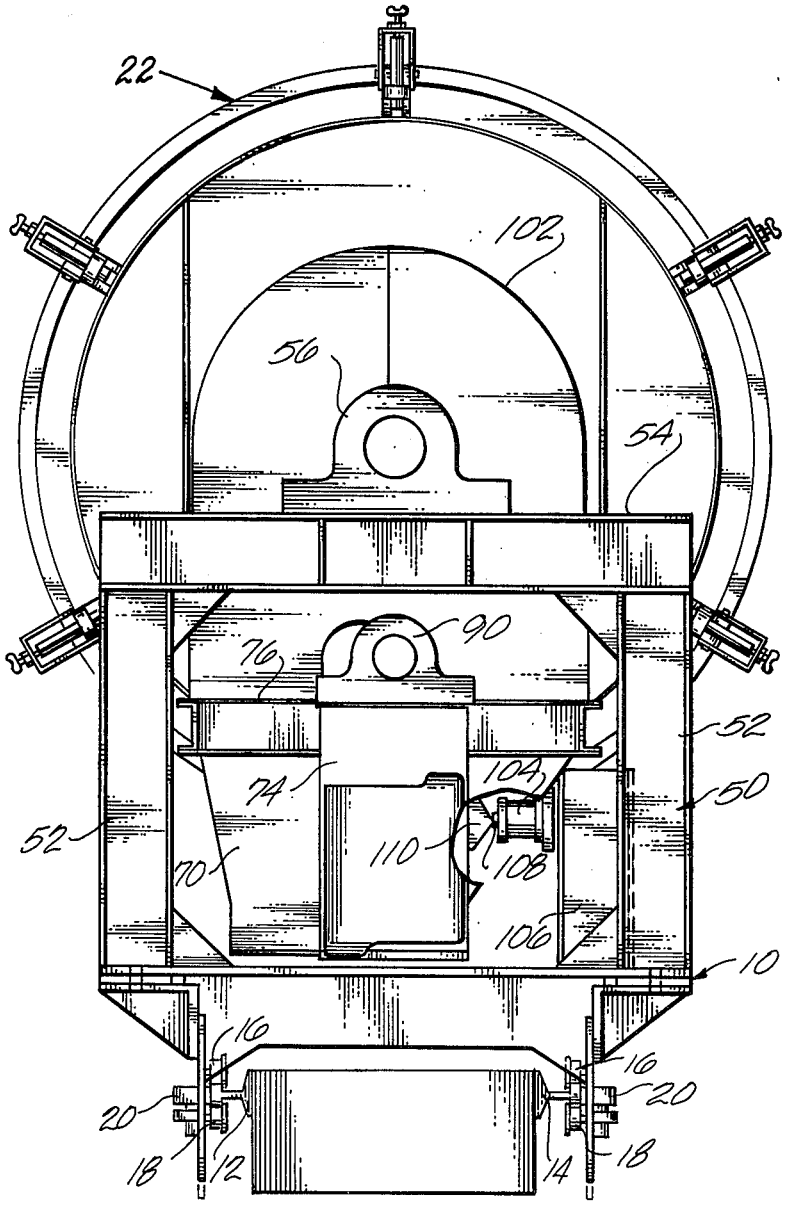
FIG. 3 is an end view of te tensioning unit.
Figure 4:
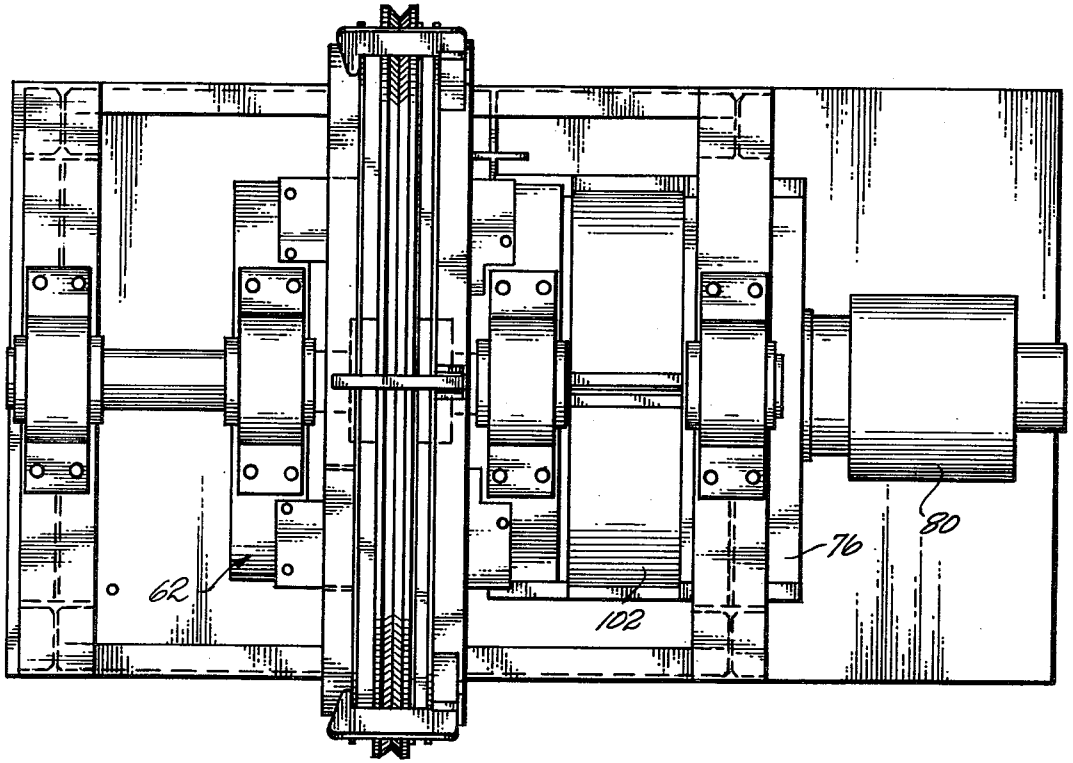
FIG. 4 is a top view of the tensioning element.

Referring to FIGS. 2, 3 and 4, the tensioning apparatus of the present invention is shown in detail. A main frame indicated generally at 50 is supported on the carriage 10. The frame 50 includes four corner legs 52 on top of which are supported a pair of horizontal cross members 54. The cross-members 54 support a pair of spaced bearing blocks 56 and 58 which rotatably support a shaft 60 at either end. The grooved bull wheel 40 is mounted on the shaft 60 at a point intermediate the bearing blocks 56 and 58.

A torque frame 62 is rotatably supported from the shaft 60 by a pair of bearing blocks 64 and 66 on either side of the bull wheel 40. The torque frame 62 includes a pair of spaced parallel side plates 68 and 70 which extend downwardly from the bearing blocks and are joined by a base plate 72. The side plates are positioned on either side of the bull wheel 40. The base plate 72 projects laterally between the vertical legs 52 of the main frame. A third vertical side plate 74 extends upwardly from the base plate 72 to support one end of cross frame member 76 extending between the side plates 70 and 74. The entire torque frame assembly 62 is rotatably supported on the shaft 60 by the bearing block 64 and 66.

A hydraulic pump 80 is mounted on and extends laterally from the side plate 74. The pump 80 is preferably of a variable displacement type permitting the discharge volume to be adjusted at any given speed. The pump is driven from the bull wheel 40 and shaft 60 through a speed multiplying belt or roller chain drive including a large diameter pulley 82 secured to the shaft 60 connected by belts or roller chain to a smaller diameter pulley 84 mounted on a jack shaft 86. The shaft 86 is journaled at either end in bearing supports 88 and 90 mounted on the intermediate frame plate 76. A large diameter pulley 92 on the jack shaft 86 in turn is connected by belts or roller chain to a small diameter pulley 94 on a shaft 96 coupled to the drive shaft and to the hydraulic pump 80. The shaft 96 is journaled in bearing supports 98 and 100 mounted on the base plate 72. A protective cover 102, shown removed in FIG. 2, encloses the belt or roller chain drive.

The tension applied to the wire as it passes from the bull wheel to the pipe on which it is being wrapped is determined by the amount of torque required to rotate the bull wheel 40. This torque is measured by a load cell in the form of a hydraulic cylinder 104 supported from the main frame 52 by a supporting bracket 106. The cylinder 104 has a piston element 108, which is engaged by a stop member 110 secured to the side plate 70 of the torque frame 62. The reaction torque produced by the load of the pump on the torque frame 70 is a result of rotation of the bull wheel 40 forcing the stop 110 against the piston 108. Preferably the piston 108 is positioned radially relative to the axis of the shaft 60 a distance equal to the outer radius of the bull wheel 40 so that one pound of tension on the wire extending around the bull wheel produces one pound of force against the piston 108. The output from the load cell is applied to a suitable gage which is calibrated to read in pounds or other unit of force the amount of force applied to the load cell, and so provide a direct calibrated measurement of tension in the wire.

In operation, the discharge from the pump 80 is directed through a throttle valve (not shown) which can be adjusted to vary the output load on the pump. The pump is adjusted so that the discharge rate of the fluid is within certain predetermined limits regardless of the rotational speed of the bull wheel, which in turn is controlled by the linear feed rate of the wire as it is wrapped on the pipe. The throttle valve is then adjusted to set the tension to the desired level as indicated by the read-out from the load cell. While normally this can be controlled manually by the operator, it will be understood that the load cell can be used as a sensor for a conventional closed loop servo system which automatically controls the load on the pump to maintain the tension at any preset level.

I claim:

1. Apparatus for applying tension to a filament while feeding the filament, comprising a frame, a circular member, means rotatably supporting the circular member on the frame for rotation about its axis of revolution, the filament passing around at least a portion of said member, a hydraulic pump, means supporting the pump, said pump supporting means being rotatable about the axis of revolution of the circular member, drive means connecting the circular member to the pump for driving the pump by rotation of the circular member, load sensing means mounted on the frame and engaging the pump supporting means, the load sensing means limiting rotation of the pump supporting means, the load sensing means engaging the pump supporting means at a radial distance from said axis of revolution that is substantially equal to the radius of the circular member.

2. Apparatus of claim 1 further including means supporting the frame for movement in a direction parallel to said axis of revolution.

3. Apparatus of claim 2 further including filament guide mounted on the frame for guiding the filament along a path tangential to the periphery of the circular member.

4. In a pipe wrapping machine for winding wire under tension around the outside of the pipe by rotating the pipe while feeding the wire onto the outside of the pipe, apparatus comprising a frame, a bull wheel journaled for rotation on the frame, the axis of rotation of the bull wheel being parallel to the axis of rotation of the pipe, means guiding the wire around the bull wheel and onto the outer surface of the pipe, means for applying a drag on the bull wheel to maintain tension in the wire between the bull wheel and the pipe, means rotatably supporting the drag applying means from the frame, the supporting means being rotatable about the same axis as the bull wheel, and stop means mounted on the frame and engaging the supporting means to limit rotation of the supporting means, the stop means including means for sensing the force exerted between the supporting means and the stop means, the stop means engaging the supporting means at a point radially spaced from the axis of rotation of the bull wheel that is equal to the radius of the bull wheel.

5. Apparatus of claim 4 wherein the drag means includes a hydraulic pump mounted on the supporting means, and means driving the pump from the bull wheel.

6. Apparatus of claim 5 wherein the drive means includes means multiplying the angular velocity of the pump relative to the angular velocity of the bull wheel.

7. Apparatus of claim 6 wherein the pump is a variable displacement pump.

* * * * *